United States Patent [19]

Straka

[11] 4,026,618

[45] May 31, 1977

[54] LOW PROFILE ELECTRICAL MALE PLUG

[76] Inventor: Robert J. Straka, 2422 S. 2nd Ave., North Riverside, Ill. 60546

[22] Filed: Dec. 31, 1975

[21] Appl. No.: 645,540

[52] U.S. Cl. ..... 339/8 P; 339/195 R; 339/196 R

[51] Int. Cl.[2] ..... H01R 39/00

[58] Field of Search ..... 339/8 R, 8 P, 6 R, 195 R, 339/195 A, 196 R, 196 A, 5 P, 5 R, 5 A

[56] References Cited

UNITED STATES PATENTS

| | | | |
|---|---|---|---|
| 1,984,181 | 12/1934 | French | 339/196 R |
| 2,027,447 | 1/1936 | Percy | 339/196 R |
| 2,226,209 | 12/1940 | Rizzuto | 339/5 P X |
| 2,433,938 | 1/1948 | Varner | 339/5 P |
| 2,564,159 | 8/1951 | Greacen, Jr. | 339/196 R X |
| 3,479,632 | 11/1969 | Galles | 339/5 R |

*Primary Examiner*—Roy Lake
*Assistant Examiner*—DeWalden W. Jones
*Attorney, Agent, or Firm*—Dominik, Knechtel, Godula & Demeur

[57] ABSTRACT

A low profile electrical plug to permit objects to be moved close to the plug when mounted to a wall socket. The electrical cord connection to the low profile plug may be rotated to any point along a 360° path.

3 Claims, 5 Drawing Figures

LOW PROFILE ELECTRICAL MALE PLUG

BACKGROUND OF THE INVENTION

This invention relates to electrical male plugs, and particularly relates to low profile electrical pugs wherein the body extending from the plug is of small dimension.

It has become desirable from a view of convenience to have electrical plugs which closely hug the wall socket. Such plugs may be designated as low profile plugs, and with such plugs it is possible to position various objects, such as furniture, close to the wall having the plug connection.

It is further desirable to make it more convenient to position the location of the electrical cord which runs from the plug to an electrical appliance, such as a lamp. Often the electrical conductor must be turned around the plug because of the orientation of the electrical appliance to such plug.

It will be appreciated that such a low profile, electric plug with a selectively positionable electric cord must have adequate conductor contacts and be free of complex structures and elements, as well as not incurring expense in its manufacture.

OBJECTS AND ADVANTAGES OF THE INVENTION

An object of the present invention is to provide a low profile electrical plug with simple and reliable conductor contacts, which plug closely adjoins the wall socket, and which electrical cord connection advantageously extends from the plug close to the wall.

Another important object of the invention is to provide a low profile electrical plug having the foregoing features as well as providing infinite selectivity and positioning of the electrical cord along a 360° path to conveniently align such electrical plug to an electrical appliance.

DESCRIPTION OF THE VIEWS OF THE DRAWINGS

The low profile electrical plug of the invention is ellustrated in the accompanying drawings which comprise a portion of the disclosure, and wherein.

DETAILED DESCRIPTION OF THE PREFERRED EMBODIMENT

Figure 1:
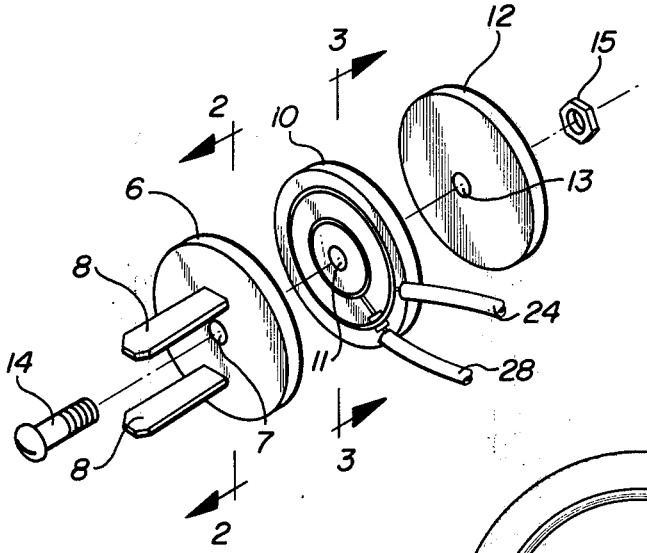
FIG. 1 is an exploded view in perspective of the low profile electrical plug.
Figure 2:
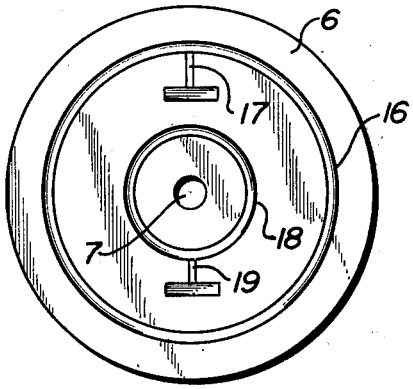
FIG. 2 is an elevational plan view along line 2—2 of FIG. 1, and on an enlarged scale.
Figure 3:
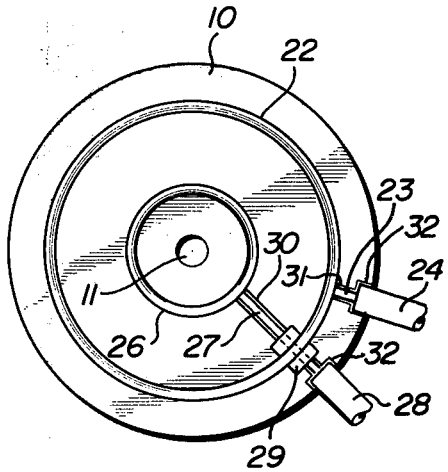
FIG. 3 is an elevational plan view taken along line 3—3 of FIG. 1, and on an enlarged scale.
Figure 4:
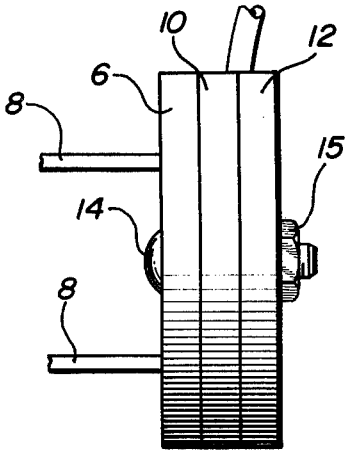
FIG. 4 is a side elevational view of the assembled low profile electrical plug, on a scale similar to that of FIGS. 2 and 3.
Figure 5:
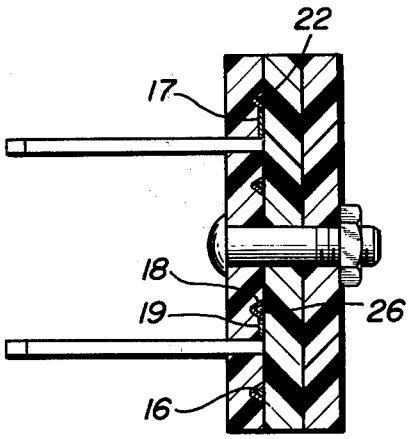
FIG. 5 is a largely sectional elevational view of the electrical plug as illustrated in the view of FIG. 4.

Looking at the drawings and at FIG. 1 particularly, there is seen an insultating prong disk 6 having a central bore 7 and male prongs 8 fixed to the front side of the disk. Such disk is a form of a plate having an insulating body member. A similar plate and insulating body member 10 is shown in the form of a rotatable cord disk, also having a central bore 11. Still another plate of an insulating body member is shown in the form of a bearing disk 12, having a central bore 13. The three bores are positioned to be aligned when the disks of substantially uniform diameter are assembled. A fastener, shown as screw 14 and nut 15, passes through the aligned bores to hold the disk assembled, and to additionally perform the function of a pivot.

The reverse side of the prong disk is provided with conductors, shown as an outer annular conductor 16 which is formed as an annular groove. A prong conductor 17 extends radially inwardly from the outer annular conductor and contacts the prong 8. An inner annular conductor 19 is also in the form of an annular groove, and connected by a radially inwardly prong conductor 19 to contact the other prong 8.

The rotatable cord disk has opposing conductors to conductively contact the conductors in the prong plates 6 when the two plates are assembled. Such conductors are also shown as being annular conductors, although it may be otherwise. An outer annular conductor is shown in the form of an annular ridge 22 with an electric cord conductor 23 shown joined to said outer annular conductor. Such electrical cord is provided with the usual insulation sheath 24. An inner annular conductor is shown in the form of an annular ridge 26. A longer, circuit completing electric cord conductor 27 is joined to the inner annular ridge 26, and said electric cord is also provided with the insulation sheath 28. An insulating block 29 separates the electrical cord conductor 27 from the outer annular ridge conductor 22.

A longer linear slit 30 is provided in the conductor face of the rotatable disk 10 to seat the longer electrical cord conductor 27. A similar linear slit 31 is provided to seat the shorter electrical cord conductor 23. The linear slits empty into insulation sheath recesses 32 in the conductor face of the rotatable disk, at the circumferential edge. Such recesses accommodate beginning portions of the insultating sheaths or covers 24, 28. The linear slits and the insulation recesses allow the prong and rotatable disk to be closely adjoined for efficient conductor contact and secure assembly.

It is only required that one of the disks has a substantially continuous conductor, and the other disk may have single conductor contacts, Thus, the prong disk may have the continuous conductor joined to the prong disks as shown, and the rotatable disk may have contact points at the ends of conductors 23, 27. Such conductors may pass through the body of disk 11, radially of from the back of the disk.

USE AND OPERATION

The prong plate and the rotatable electric cord plate are adjoined so that the opposing conductors contact one another. A pivot is mounted, such as a fastener, and the rotatable disk plate is then selectively rotated to any position in a 360° path to most conveniently orientate the electrical cord to an electrical appliance. One of the plates has conductor contacts which engage opposing substantially continuous conductors in the other plate to form the conductive contact. A tongue and groove relationship may be provided to more securely hold the assembly together. A bearing plate is provided in which a smooth bearing surface is juxtaposed to the back of the rotatable disk plate, which also presents a smooth bearing surface. All three plates are secured by a pivot fastener to permit rotation of the middle or rotatable disk while the other disks remain stationary. A low profile electrical plug results which is in close proximity to the wall outlet, and which electric cord extends radially relative to the rotatable disk, thus eliminating folding, twisting or other undesirable placements of the electrical cord at its junction to the electrical plug.

It will also be appreciated that the prong plate could be provided only with prong conductors, such as 17 and 19, which are conductively contacted by the continuous or annular conductors on the rotable disk. It will also be appreciated that conductors 23, 27 may be connected to countersunk screws joined by conducting clips to the continuous conductors or they may be welded or formed integrally with such conductors. Continuous conductors on the rotatable disk can contact the prong conductors in any rotated position. The annular form is preferred but it may be otherwise so long as there is electrical contact in any rotated position.

The claims of the invention are now presented and the terms of such claims may be further understood by reference to the language of the preceding description and the views of the drawings.

What is claimed is:

1. A low profile electrical plug having a rotatable selectively positionable electric cord connection comprising a prong plate having an insulating body member with a pair of spaced electrical prongs on one side thereof and a prong conductor coupled to each of said electrical prongs on the other side thereof;

a rotatable electric cord plate having an insulating body member;

said prong plate and said cord plate being proportioned to provide a low profile electrical plug when pivotally secured together in a sandwich-type relationship;

a spaced pair of outer and inner conductors on said prong plate and a pair of outer and inner conductors on said cord plate which are spaced and positioned to electrically and conductively contact the respective outer and inner conductors on said prong plate when said prong plate and said cord plate are secured together in sandwiched relationship, said outer and inner conductors on said prong plate and said cord plate being disposed with annular grooves in the insulating body member and said outer and inner conductors on the other one thereof being adapted to seat within said annular grooves to establish electrical contact therewith, said outer and inner conductors further being joined so as to provide continuous electrical contact as said prong plate and said cord plate are selectively rotated with respect to one another; and electric cord conductors affixed to said cord plate and extending radially therefrom so that said electric cord conductors rotate with said cord plate, said electric cord conductors being electrically coupled to the respective ones of said outer and inner conductors on said cord plate.

2. A low profile electrical plug which includes the features of Claim 1 wherein the rotatable electric cord plate includes a pair of linear slits, the electrical conductors being seated in said slits, one linear slit extending to one of the spaced conductor points and the other linear slit extending to the other of the spaced conductor points.

3. A low profile electrical plug which includes the features of claim 1 and which further includes an outer bearing plate having a bearing surface to slidingly contact a bearing surface on the back of the rotatable electric cord plate, and said bearing plate being joined to said pivot connection, whereby the rotatable electric cord plate rotates between the prong plate and said bearing plate, with an aligned central bore in each of the plates and said pivot being a fastener extending through the aligned bores.

* * * * *